US010907470B2

(12) United States Patent
Gissler et al.

(10) Patent No.: US 10,907,470 B2
(45) Date of Patent: Feb. 2, 2021

(54) COPPER TAPED CABLE

(71) Applicant: Halliburton Energy Services, Inc., Houston, TX (US)

(72) Inventors: Robert W. Gissler, Spring, TX (US); Hai Bi, The Woodlands, TX (US); Aswin Balasubramanian, Spring, TX (US); Quanling Zheng, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 18 days.

(21) Appl. No.: 15/558,111

(22) PCT Filed: Oct. 5, 2016

(86) PCT No.: PCT/US2016/055568
§ 371 (c)(1),
(2) Date: Sep. 13, 2017

(87) PCT Pub. No.: WO2018/067146
PCT Pub. Date: Apr. 12, 2018

(65) Prior Publication Data

US 2018/0374611 A1 Dec. 27, 2018

(51) Int. Cl.
*E21B 47/12* (2012.01)
*H01B 1/02* (2006.01)
(Continued)

(52) U.S. Cl.
CPC ..... *E21B 47/12* (2013.01); *E21B 17/003* (2013.01); *H01B 1/02* (2013.01); *H01B 1/04* (2013.01);
(Continued)

(58) Field of Classification Search
CPC ... E21B 17/003; E21B 47/12; H01B 11/1808; H01B 11/183; H01B 1/02; H01B 1/04; H01B 7/02; H01B 7/046
See application file for complete search history.

(56) References Cited

U.S. PATENT DOCUMENTS 4,077,022 A * 2/1978 Pitts, Jr. ..... E21B 17/206 174/105 R
5,894,104 A * 4/1999 Hedberg ..... H01B 7/046 174/36
(Continued)

FOREIGN PATENT DOCUMENTS

GB 827866 2/1960

OTHER PUBLICATIONS

International Search Report and Written Opinion for PCT Application No. PCT/US2016/055568 dated Jun. 9, 2017.

*Primary Examiner* — Caroline N Butcher
(74) *Attorney, Agent, or Firm* — Scott Richardson; C. Tumey Law Group PLLC

(57) ABSTRACT

A cable assembly, well system, and method of use. A cable assembly may comprise a protective covering and a cable disposed in the protective covering. The cable may comprise a center conductor, an insulator. The insulator may be disposed about the center conductor. The cable may comprise an extra conductive layer, where the extra conductive layer may comprise copper and may be disposed about the insulator, and an outer conductive casing. A well system may comprise a cable assembly, which may comprise a protective covering, and a cable. The well system may further comprise downhole equipment disposed in a wellbore, wherein the downhole equipment may be connected to the cable assembly. A method for using a cable assembly in a well may comprise providing the cable assembly, inserting the cable
(Continued)

assembly in the well, and sending a signal current through the cable assembly from the surface to downhole equipment.

20 Claims, 6 Drawing Sheets

(51) Int. Cl.

| | |
|---|---|
| ***H01B 1/04*** | (2006.01) |
| ***H01B 7/04*** | (2006.01) |
| ***E21B 17/00*** | (2006.01) |
| ***H01B 7/02*** | (2006.01) |
| ***H01B 11/18*** | (2006.01) |

(52) U.S. Cl.
CPC ..... *H01B 7/02* (2013.01); *H01B 7/046* (2013.01); *H01B 11/183* (2013.01); *H01B 11/1808* (2013.01)

(56) References Cited

U.S. PATENT DOCUMENTS

| | | | | |
|---|---|---|---|---|
| 6,220,346 | B1 | 4/2001 | Gissler | |
| 6,269,883 | B1 | 8/2001 | Gissler et al. | |
| 6,349,767 | B2 | 2/2002 | Gissler | |
| 6,397,945 | B1 | 6/2002 | Manke et al. | |
| 2005/0070144 | A1* | 3/2005 | Hall | E21B 17/003 439/191 |
| 2008/0106972 | A1* | 5/2008 | Liang | E21B 47/12 367/25 |
| 2010/0012348 | A1 | 1/2010 | Varkey et al. | |
| 2012/0063931 | A1* | 3/2012 | Rumbaugh | F04B 47/06 417/410.1 |
| 2013/0306348 | A1* | 11/2013 | Holzmueller | H01B 9/02 174/105 R |
| 2014/0102749 | A1* | 4/2014 | Varkey | H01B 7/046 174/102 R |
| 2016/0097268 | A1* | 4/2016 | Okoniewski | E21B 43/2401 166/248 |
| 2016/0290063 | A1* | 10/2016 | Richards | E21B 47/01 |

* cited by examiner

COPPER TAPED CABLE

BACKGROUND

Cable assemblies may be used in various types of wellbore applications. Generally, the cable assemblies may be used to transmit power, information, and/or commands through a central conductor with a signaling current. Frequently, the use of cable assemblies may be limited by distance. As signal currents move away from the original source the signal current may attenuate and dissipate over long distances. Materials used within a cable assembly may be designed for protection against a downhole environment, which may not be good conductors and/or do not adequately prevent attenuation. These materials may hinder the movement of the signal current, which may cause signal currents to dissipate and attenuate. Consequently, this effect may result in degraded, noisy, and/or lost signals. This may be of particular concern in certain types of cable assemblies, for example, cable assemblies that may be disposed in deep wellbores that traverse long distances.

Examples of past techniques for addressing these issues may include thicker cables and avoiding long cable assemblies. However, these solutions do not allow for sufficient flexibility with regards to deeper wells as space may be limited for larger cables and attenuation may continue to plague signal current transmission downhole. Furthermore, cost may increase as larger cables may require alternate connections with downhole equipment, which may require alterations to current connections with downhole equipment.

BRIEF DESCRIPTION OF THE DRAWINGS

These drawings illustrate certain aspects of some of the embodiments of the present invention, and should not be used to limit or define the invention.

DETAILED DESCRIPTION

Disclosed are systems, assemblies, and methods that may utilize an extra conductive layer within a cable assembly for the transmission of signal currents. The signal currents may be transmitted downhole and/or uphole. More particularly, systems, assemblies, and methods may be provided for applying an extra conductive layer within the cable assembly and using the cable assembly containing extra conductive layer within wellbore applications. The term "cable," as used herein, refer to physical structures that guide high frequency signaling currents. The cable may be used in any application requiring the transmission of power and/or information between two locations. A protective covering may be used to protect the cable and its components from external forces and external materials. One of the many potential advantages of the systems, assemblies, and methods described herein is that the cable with extra conductive layer may be able to replace existing cable assemblies used in a completed well without alterations to downhole equipment and/or existing wellbore methods, assemblies, and/or services. The extra conductive layer may provide a reduction in the attenuation of a communication signal, which may allow the cable assembly to be disposed deeper into a wellbore. Additionally, the cable assembly may be used with current downhole equipment and surface controls, which may prevent costs from increasing during deeper wellbore applications.

Figure 1:
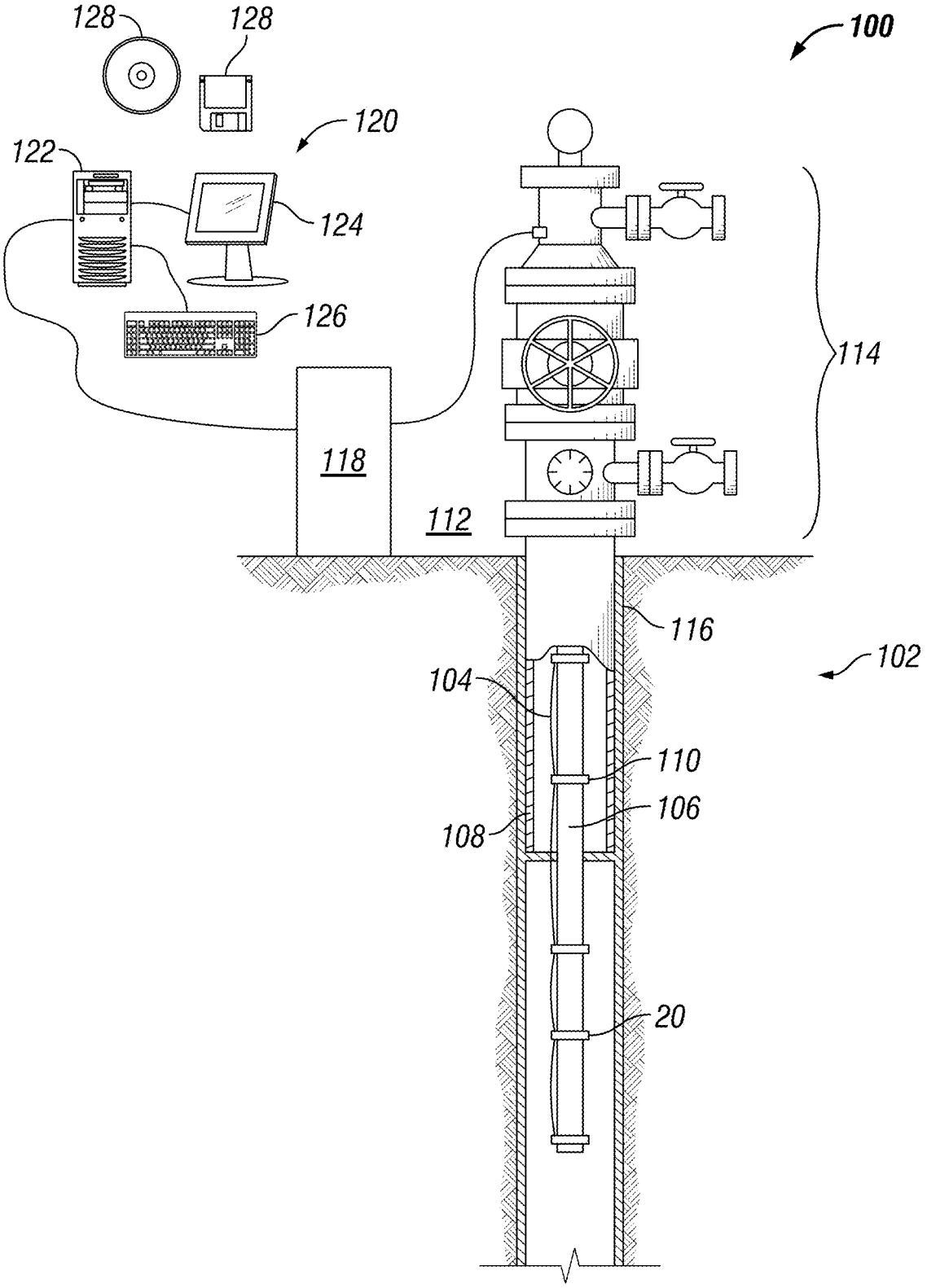
FIG. 1 is an illustration of an example of a completed well.

FIG. 1 generally illustrates an example of a well system 100 that may be used in a completed well 102, which may comprise a cable assembly 104. In examples, cable assembly 104 may be referred as tubing enclosed cable ("TEC"). As will be disused in more detail below with reference to FIG. 2 and FIG. 3, cable assembly 104 may comprise a copper tape cable in which the copper tape is the extra conductive layer, (e.g. cable 130). In FIG. 1, cable assembly 104 may be disposed along production tubing 106 and further within casing 108. Cable assembly 104 may be communicatively coupled to downhole equipment 110. Cable assembly 104, as described below, may send information and/or commands to downhole equipment 110 from surface 112. In examples, downhole equipment 110 may comprise submersible pumps, sensors, control modules for ICVs, and flow meters. Downhole equipment 110 may send information back to surface 112 for processing and/or review. As illustrated, completed well 1 may comprises a series of valves 114 and other apparatuses, which may be used to cap completed well 1. In examples, casing 108 may be inserted into wellbore 116. Additionally, production tubing 106 may be inserted into casing 108. Cable assembly 104 may be coupled within casing 108, either by attachment to production tubing 106 and/or attachment to the internal portion of casing 108. Signal generator/detector 118 may be coupled to cable assembly 104 in order to transmit a signal downhole. Signal generator/detector 118 may be self-contained and/or coupled to an information handling system 120.

Any suitable technique may be used for transmitting signals from downhole equipment 110 to surface 112. As illustrated, cable assembly 104 may transmit data from downhole equipment 110 to information handling system 120, disposed on surface 112. Information handling system 120 may include a processing unit 122, a monitor 124, an input device 126 (e.g., keyboard, mouse, etc.), and/or computer media 128 (e.g., optical disks, magnetic disks) that may store code representative of the methods described herein. Information handling system 120 may be disposed on downhole equipment 110 or otherwise positioned on surface 112. Information handling system 120 may act as a data acquisition system and possibly a data processing system that analyzes information from downhole equipment 110. This processing may occur at surface 112 in real-time. Alternatively, the processing may occur at another location after recovery of downhole equipment 110 from wellbore 116 or the processing may be performed by an information handling system 120 in wellbore 116, which may be transmitted in real-time.

Figure 2:
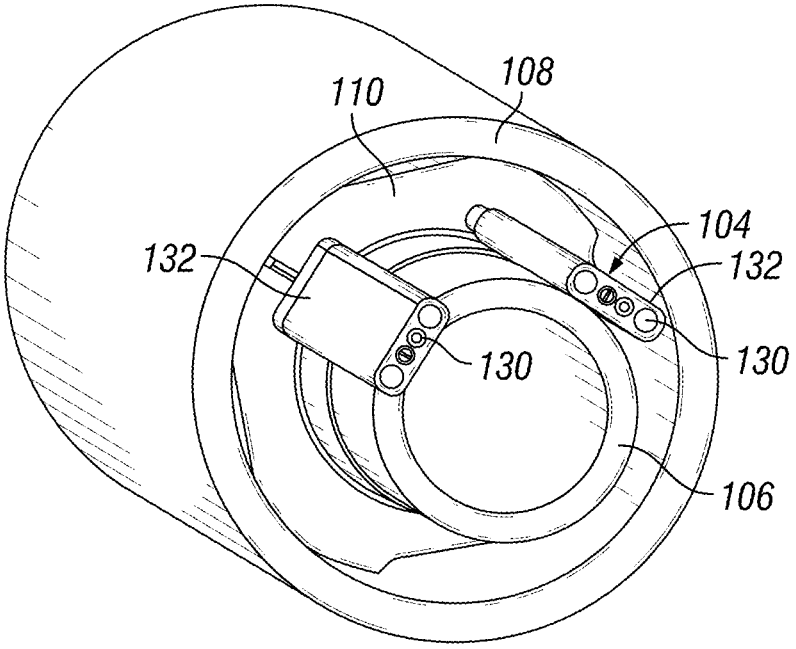
FIG. 2 is an illustration of an example of a cable assembly.

FIG. 2 illustrates a cable assembly 104 that may be disposed downhole for communication with downhole equipment 110. In examples, cable assembly 104 may be disposed adjacent production tubing 106 and may be further disposed within casing 108. It should be noted that cable assembly 104 may be shorted to production tubing 106 at any suitable location along production tubing 106. The outer layer of cable assembly 104 may be stripped off, which may allow cable assembly 104 to attach to production tubing 106 with splice subs, not illustrated, with clamps at termination points. Without limitation, cable assembly 104 may attach to downhole equipment 110 and may provide power and/or communication from surface 112 (e.g. FIG. 1) to downhole equipment 110. Without limitation, downhole equipment 110 may be any device and/or devices that may maintain production tubing 106 and/or casing 108 and/or assist in the recovery of hydrocarbons in wellbore 116. In examples, downhole equipment 110 may produce, increase, and/or decrease the flow of hydrocarbons from a formation (not illustrated) through production tubing 106. Cable assembly 104 may comprise a cable 130 and/or a plurality of cables 130 that may be disposed in a protective covering 132. Protective covering 132 may comprise PFA, PFE, FEP, ETFE, TEFZEL™, TEFLON™, propylene, santoprene. In examples, protective covering 132 may be identified as a "flat pack." Without limitation, there may be a plurality of protective coverings 132 for redundancy and/or for separate communication with individual downhole equipment 110. Cable assembly 104 may facilitate reservoir management that may be efficient and fast.

Figure 3:
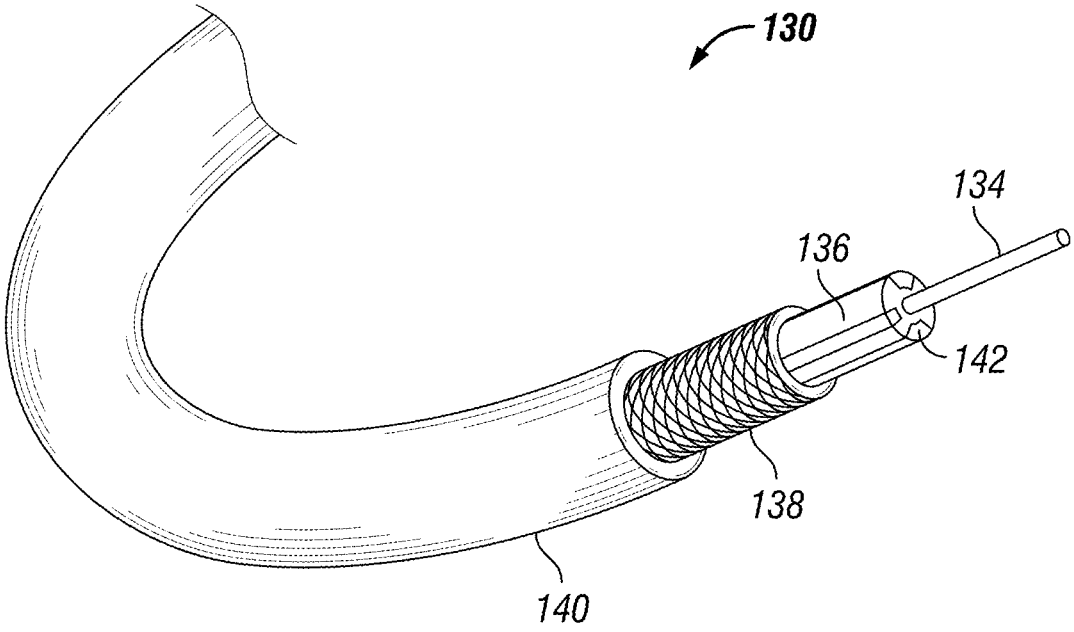
FIG. 3 is an illustration of an example cable with a portion cut away exposing the interior of the cable.

FIG. 3 illustrates a cross section of cable 130 disposed within protective covering 132 (e.g. FIG. 2). In examples, cable 130 may comprise a center conductor 134, an insulator 136, an extra conductive layer 138, outer conductive casing 140, and air gaps 142. In examples, center conductor 134 may comprise a conductive medium. Without limitation, a suitable conductive medium may be, but is not limited to copper, brass, bronze, and/or any other conductive material. Center conductor 134 may be used to transmit data downhole with signaling currents and may be about 0.067 inch to about 1.1875 inches in diameter. Center conductor 134 may be disposed within insulator 136. In examples, insulator 136 may comprise high temperature polymer insulation material, such as PFA, PFE, FEP, ETFE, TEFZEL™, TEFLON™, and/or any similar material. Insulator 136 may prevent external currents from interfering with the currents traversing center conductor 134. In examples, insulator 136 may be disposed within extra conductive layer 138.

Figure 4A:
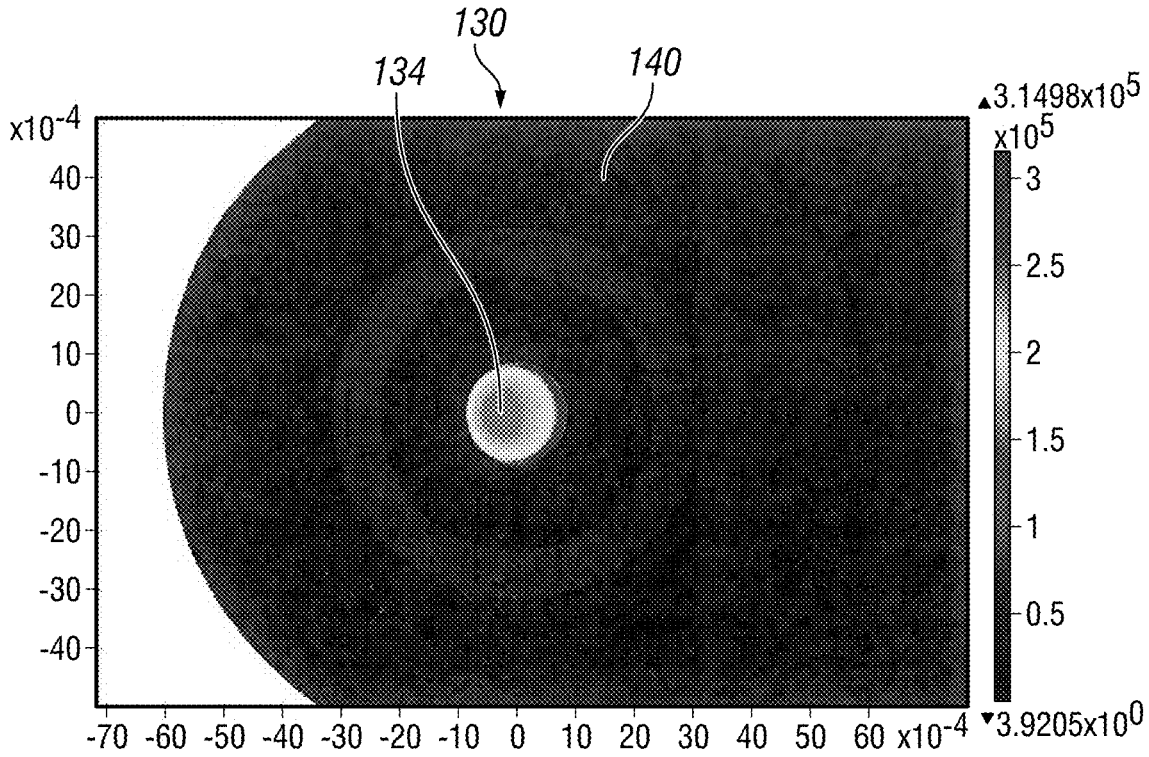
FIG. 4*a* is a graph illustrating signal strength within a cable without an extra conductive layer.
Figure 4B:
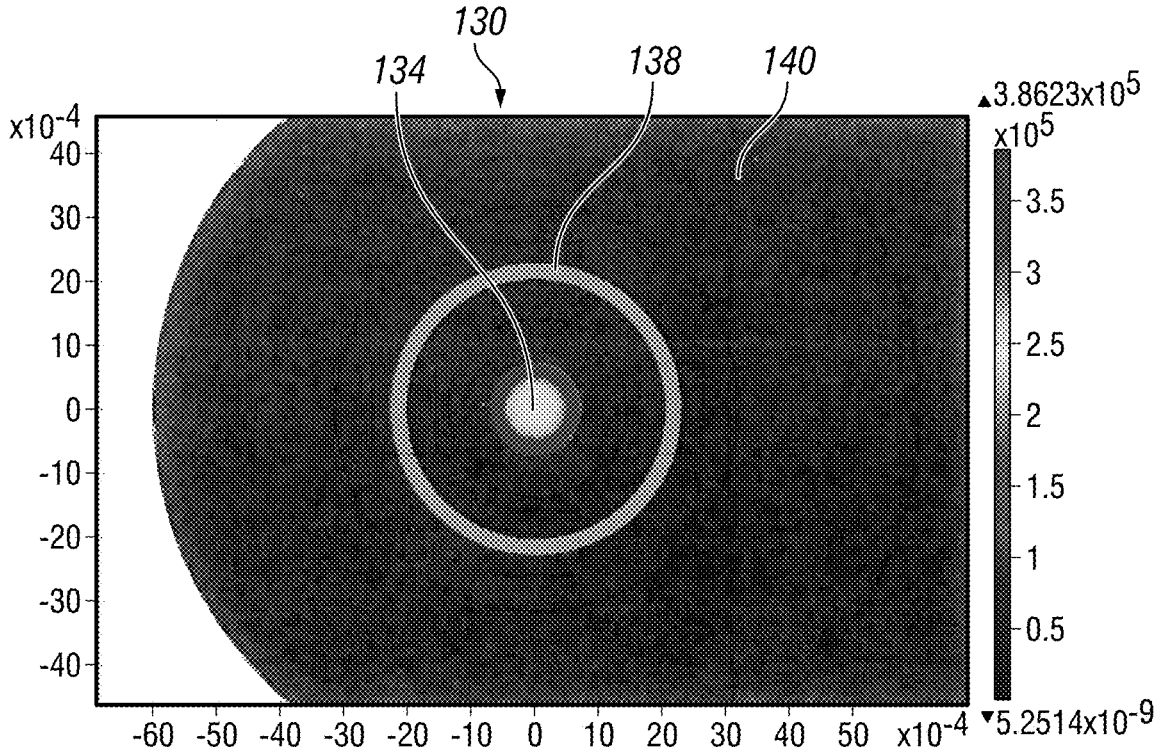
FIG. 4*b* is a graph illustrating signal strength within a cable with an extra conductive layer.
Figure 5:
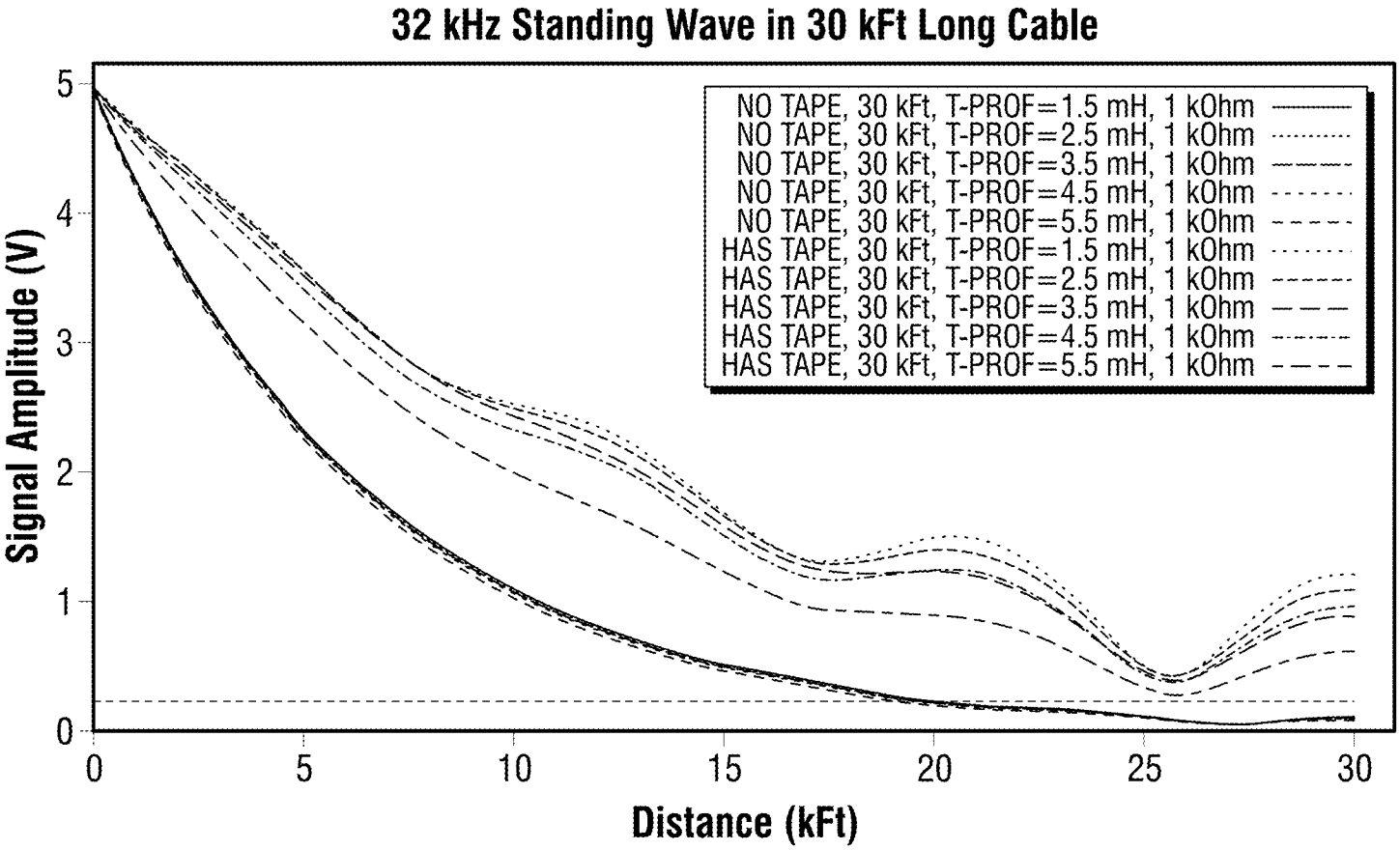
FIG. 5 is a graph illustrating signal strength loss over distance.

Extra conductive layer 138 may comprise copper, brass, bronze, or any other conductive material and in any form such as mesh, strips, and/or tape. In examples, extra conductive layer 138 may be in contact with the inner diameter of outer conductive casing 140 and may act as a ground path for cable assembly 104. The outer conductive casing 140 may be incoloy, inconels, duplex stainless steels, 300 series stainless steels and/or other types of conductive materials. Two extra conductive layers 138 may be pulled together and/or forced together during the manufacturing process. For example, signaling currents may be direct current and/or alternating current. Thus, signaling currents transmitted using direct current may work well when production tubing 5 acts as a ground path. However, signaling currents transmitted using alternating currents may attenuate in production tubing 5 before the signal may be recorded, which may lead to a loss of information. In downhole operations, alternating current may be used, as it may be easier on equipment to transmit information efficiently. Extra conductive layer 138 may be a medium of low resistance, which may allow signaling currents to travel further without attenuating, preventing the loss of information. In examples, where cable 130 without extra conductive layer 138, the skin effect may lead to attenuation of signaling current. The skin effect may be defined as when signaling currents are largely confined to the top most surface layers of a conductor, the proportion of the total current carried by a specified thickness of the conductor may be dependent on the frequency, and the dimension and electrical properties of the conductor. FIGS. 4*a* and 4*b* illustrated signal strength in cable 130 without extra conductive layer 138 and with extra conductive layer 138, respectively. Referring to FIG. 4*a*, the graph illustrates a signal strength that may be reduced and attenuated as outer conductive casing 140 may have limited contribution to maintaining signal strength due to skin effect. As discussed below, outer conductive casing 140 may be designed to protect center conductor 134 and extra conductive layer 138. Outer conductive casing 140 may not be a good path for alternating signal currents to traverse due to attenuation. Referring to FIG. 4*b*, the inclusion of extra conductive layer 138 may improve signal strength for cable 130. In examples, signaling currents may more effectively traverse extra conductive layer 138, due to reduced resistance, than outer conductive casing 140. Thus, extra conductive layer 138 may improve signal strength performance over distance within cable 130. Improved transmission over distance in cable 130 may be illustrated in FIG. 5. As graphed, measurements of signal strength of three cables without extra conductive layer 138 exponentially lose signal strength as distance increases from the original source. However, measurements of signal strength of three cables with extra conductive layer 138 reduce the amount of signal loss as distance increases from the original source. Therefore, extra conductive layer 138 may be beneficial component of cable 130 in preventing signal strength loss over distance.

Signaling currents may be described as a way to delivery data in the form of alternating voltage and current along the cable, where two conductive layers may form a waveguide. To send binary information along cable 130, a certain frequency may be used for '0', while another frequency and/or no modulation may be used for '1'. The carrier frequency may be high enough for the cable assembly 104 to be regarded as a waveguide when the wavelength of the alternating signal may be comparable to the cable length. At this conditions, Maxwell equation may be used to apply analysis on electrical and magnetic field for attenuation of the signals. In general, the alternating current signal at this frequency may not use the advantage of a large cross section of the metal outer conductive casing 140, but instead, it may traverse through a very thin layer at the surface (skin effect).

In examples, the degradation of extra conductive layer 138 may be prevented by outer conductive casing 140. Outer conductive casing 140 may protect extra conductive layer 138 from downhole conditions and elements. Outer conductive casing 140, referring to FIG. 3, without limitation, may comprise any of a variety of suitable material, wherein suitable material may be incoloy and/or stainless steel. In examples, outer conductive casing 140 may enclose center conductor 134, insulator 136, extra conductive layer 138, and air gaps 142 under pressure, which may prevent the components of cable 130 from moving during wellbore operations. Additionally, outer conductive casing 140 may act as a shield and prevent external forces and material from degrading components of cable 130. In examples, cable 130 may bend around production tubing 106 and/or within casing 108. Outer conductive casing 140 may prevent the breaking and over extension of components within cable 130. Additionally, air gaps 142 in insulator 136 may further relieve mechanical and lateral stress placed upon components within cable 130 as cable 130 is bent. Air gaps 142 may be spaced circumferentially around insulator 136. In examples, there may be a plurality of air gaps 142 that may comprise any suitable shape. A suitable shape may be, but is not limited to circular, triangular, square, rectangular, polyhedral, and/or any combination thereof. Air gaps 142 may comprise a suitable volume which may expand and/or contract as cable 130 is bent and/or defined. Air gaps 142 may allow center conductor 134, insulator 136, and/or conductive layer 138 to move within cable 130 without shearing, destroying other components, and/or coming out an end of cable 130. Additionally, air gaps 142 may traverse the length of cable 130 in a straight line and/or may twist as air gaps 142 traverse the length of cable 130. Air gaps 142 may increase the life of components of cable 130 and may prevent the premature failure of cable 130 if cable 130 is placed into a bent state.

Figure 6:
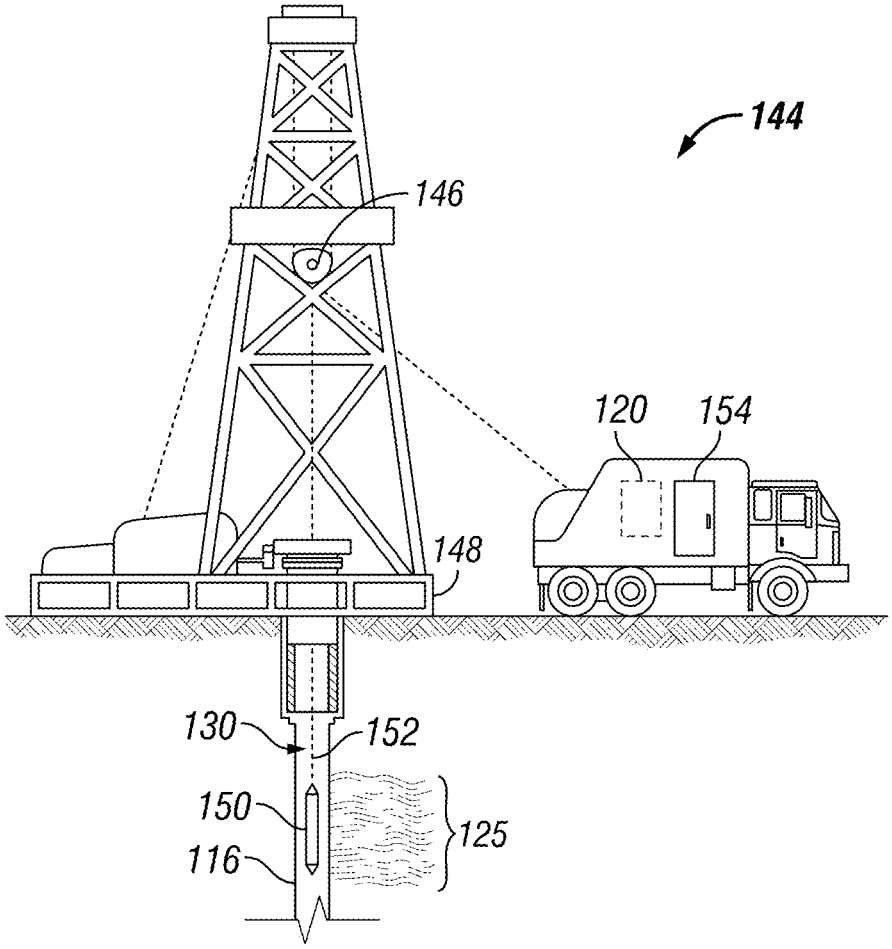
FIG. 6 illustrates an example of a wireline system.

FIG. 6 generally illustrates an example of a wireline system 144 that may be representative of a technique for use of cable 130 in a well. Hoist 146 may be included as a portion of platform 148 and used to raise or lower downhole equipment 110, for example, wireline sonde 150 into or out of wellbore 116. In FIG. 6, a tether 152 may attach wireline sonde 150 to hoist 146. Tether 152 may comprise cable 130 and/or a bundle of cables 130. Cables 130 may provide a communicative coupling between logging facility 154 (which may comprise an information handling system 120) and wireline sonde 150. Cables 130 may be protected from external forces and/or material by protective covering 132, as illustrated by any of the examples described herein or illustrated in FIG. 6, which may prevent or slow degradation of cables 130. In this manner, information about subterranean formation 125 may be obtained with a reduced risk of cable assembly 104 incurring damage due to external forces and/or material.

Figure 7:
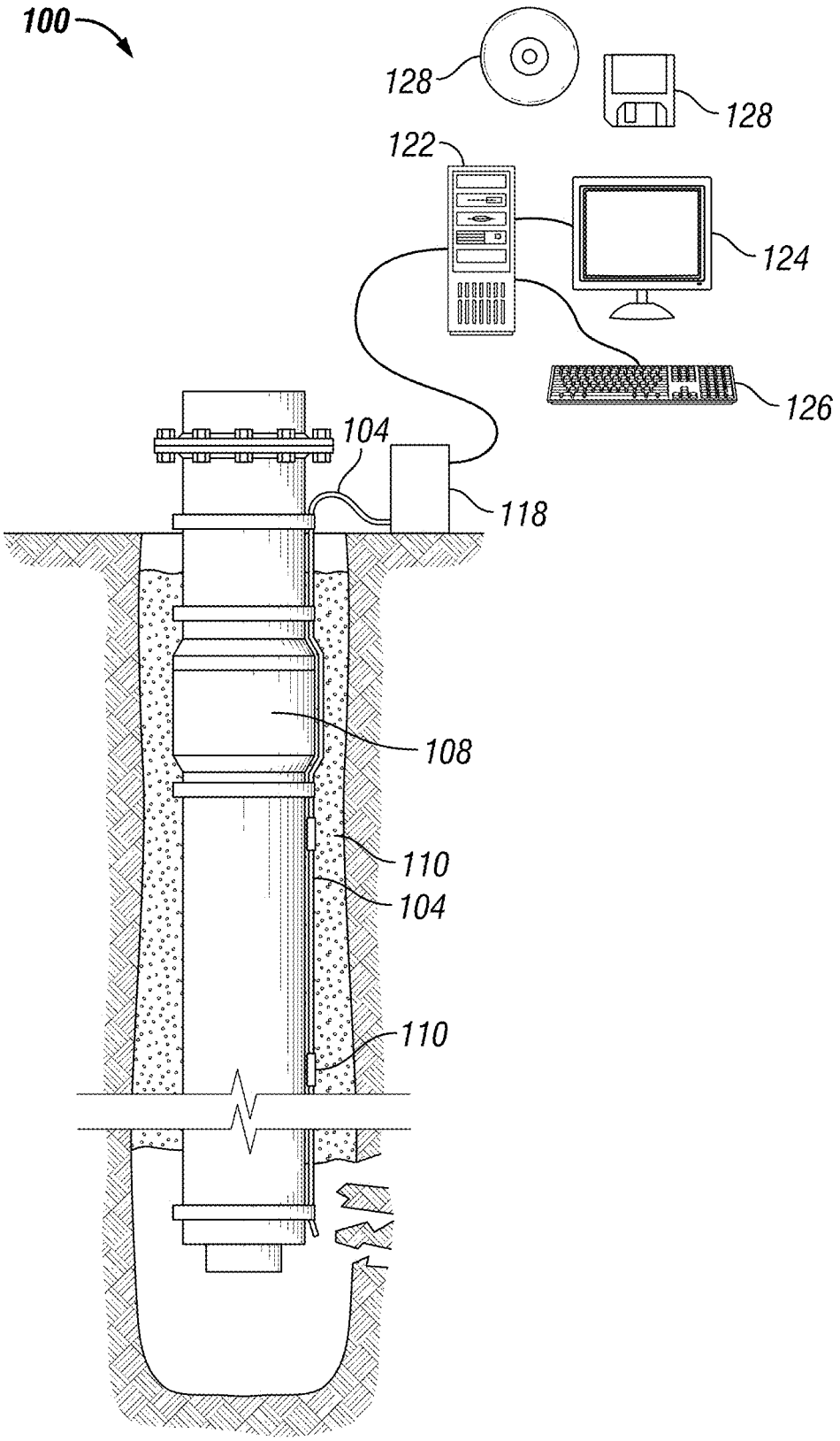
FIG. 7 illustrates an example of a cable assembly disposed outside of a casing.

FIG. 7 generally illustrates another example of a well system 100 that may be representative of a well being monitored using cable assembly 104. In FIG. 7, cable assembly 104 may be a communication and/or power line as discussed above. As illustrated, cable assembly 104 may connect to downhole equipment 110, which may be any type of suitable instrument. Downhole equipment 110 and cable assembly 104 may be disposed outside of casing 108. Production tubing 106 (referring to FIG. 1) and/or a wireline system 144 (referring to FIG. 6) may be inserted into casing 108. Cable assembly 104 may be disposed on the outside of casing 108. In examples, cable assembly 104 may be coupled within casing 108, either by attachment to the production tubing or attachment to the internal portion of casing 108. Signal generator/detector 118 may be coupled to cable assembly 104 in order to transmit a signal downhole. Signal generator/detector 118 may be self-contained and/or coupled to an information handling system 120. As discussed above, information handling system 120 may include a processing unit 122, a monitor 124, an input device 126 (e.g., keyboard, mouse, etc.), and/or computer media 128 (e.g., optical disks, magnetic disks) that may store code representative of the methods described herein.

A method for using a cable assembly 104 in a well may be provided. The method may comprise disposing a cable assembly 104 downhole within a well. In examples, cable assembly 104 may be inserted into completed wells and/or wells being drilled. Cable assembly 104 may be disposed on production tubing 106, casing 108, and/or on a drill string. In examples, cable assembly 104 may attach to any number and/or types of downhole equipment 110 and may provide power and communication to downhole equipment 110 from surface 112. Information and/or commands may be sent through cable 130, traversing center conductor 134 to downhole equipment 110. Information may be sent back to the surface from downhole equipment 110 through extra conductive layer 138. Extra conductive layer 138 may prevent attenuation of signal strength and may allow for information and/or commands to be sent to and from downhole equipment 110 in deeper wells. In contract, cable 130 without conductive layer 138 may require additional downhole devices that may boost signaling currents, which may allow them to travel further downhole. Additionally, signaling currents may attenuate to the point that information may be lost and/or skewed, which may make received information unreliable. Extra conductive layer 138 may comprise copper wound (e.g., copper tape) around insulator 136. Air gaps 142 may prevent components of cable 130 from shearing, deforming, and/or coming out of cable 130 when cable 130 may be bent within a wellbore 116. When bent, air gaps 142 may expand and/or contract, which may allow for components of cable 130 to shift into a void created by air gaps 142. In examples, cable assembly 104 may be permanently disposed within a wellbore and/or removed from wellbore 116 after the used of downhole equipment 110.

A cable assembly may comprise a protective covering and a cable disposed in the protective covering. The cable may comprise a center conductor, an insulator, where the insulator may be disposed about the center conductor, an extra conductive layer, where the extra conductive layer may comprise copper and may be disposed about the insulator. The cable may further comprise an outer conductive casing, wherein the outer conductive casing may be disposed about the conductive layer.

A well system may comprise a cable assembly, which may further comprise a protective covering and a cable. The cable may comprise a center conductor, an insulator, where the insulator may be disposed on the center conductor, an extra conductive layer, where the extra conductive layer may be copper tape and may be disposed on the insulator. The cable may further comprise an outer conductive casing, where the outer conductive casing may be disposed on the conductive layer and a downhole equipment that may be disposed in a wellbore, where the downhole equipment may be connected to the cable assembly.

A method for using a cable assembly in a well may comprise providing the cable assembly, where the cable assembly may comprise a protective covering and a cable, wherein the cable may comprise a center conductor. The cable assembly may further comprise an insulator, where the insulator may be disposed about the center conductor, an extra conductive layer, where the extra conductive layer may comprise copper and may be disposed about the insulator, and an outer conductive casing, where the outer conductive casing may be disposed about the conductive layer. The method may further comprise inserting the cable assembly in the well and sending a signal current through the cable assembly from a surface to a downhole equipment in the well. The cable assembly, well system, and method may include any of the various features of the compositions, methods, and systems disclosed herein, including one or more of the following features in any combination.

The extra conductive layer may further comprises gold, silver, or graphene. The extra conducive layer may be disposed on an inner diameter of the outer conductive casing. The outer conductive casing may comprise incoloy. The extra conductive layer may be in the form of a tape wound around the insulator. The cable assembly may comprise a plurality of cables within the protective covering. A plurality of cable assemblies may be disposed downhole. The cable assembly may be disposed within a tether and the tether may connect a wireline sonde to a hoist. The cable assembly may be used for sending a signal current through a center conductor of the cable from a surface to a downhole equipment in a wellbore. The cable assembly may be used for sending a second signal current from the downhole equipment to the surface through the extra conductive layer of the cable. The cable assembly may be used for sending power from a surface to a downhole equipment through the cable assembly. The extra conductive layer may be in the form of a tape wound around the insulator.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention.

What is claimed is:

1. A cable assembly comprising:

a protective covering comprising a flat pack;

an insulator sleeve disposed concentrically within the protective covering;

a center conductor disposed concentrically within the insulator sleeve; and an air gap extending longitudinally along the cable assembly, the air gap positioned between the protective covering and the insulator sleeve; and wherein a portion of the cable assembly is shorted to production tubing, wherein the flat pack covers the portion of the cable assembly that is shorted to the production tubing.

2. The cable assembly of claim 1, further comprising an extra conductive layer, wherein the extra conductive layer encompasses the insulator sleeve, wherein the center conductor is configured to receive commands, wherein the extra conductive layer is configured to receive information from downhole equipment.

3. The cable assembly of claim 2, wherein the extra conductive layer comprises copper, wherein the flat pack comprises santoprene.

4. The cable assembly system of claim 3, further comprising an outer conductive casing, wherein the outer conductive casing encompasses the extra conductive layer.

5. The cable assembly of claim 4, wherein the outer conductive casing comprises inconels.

6. The cable assembly of claim 5, further comprising a plurality of the air gaps.

7. A cable assembly comprising:

a protective covering comprising a flat pack;

a center conductor;

an insulator encompassing the center conductor;

an extra conductive layer encompassing the insulator;

an outer conductive casing encompassing the conductive layer; and an air gap extending longitudinally along the cable assembly, the air gap positioned between and adjacent to the insulator and the extra conductive layer;

wherein a portion of the cable assembly is shorted to production tubing, wherein the flat pack covers the portion of the cable assembly that is shorted to the production tubing.

8. The cable assembly of claim 7, wherein the extra conductive layer comprises graphene.

9. The cable assembly of claim 7, further comprising a plurality of the air gaps.

10. The cable assembly of claim 7, wherein the outer conductive casing comprises inconels.

11. The cable assembly of claim 7, wherein a diameter of the center conductor ranges from about 0.067 inch to about 1.1875 inches.

12. The cable assembly of claim 7, wherein the extra conductive layer comprises copper.

13. The cable assembly of claim 7, wherein a plurality of cable assemblies are disposed downhole.

14. The cable assembly of claim 7, wherein the cable assembly is disposed within a tether and the tether connects a wireline sonde to a hoist.

15. The cable assembly of claim 7, wherein the cable assembly connects to downhole equipment.

16. A method for using a cable assembly in a well comprising:

providing the cable assembly, wherein the cable assembly comprises:

a protective covering comprising a flat pack;

an insulator sleeve disposed concentrically within the protective covering;

a center conductor disposed concentrically within the insulator sleeve;

an extra conductive layer, wherein the extra conductive layer comprises copper and encompasses the insulator sleeve;

an outer conductive casing encompassing the extra conductive layer; and an air gap extending longitudinally along the cable assembly, the air gap positioned between the protective covering and the insulator sleeve;

wherein a portion of the cable assembly is shorted to production tubing, wherein the flat pack covers the portion of the cable assembly that is shorted to the production tubing;

inserting the cable assembly in the well; and sending a signal current through the cable assembly from a surface to downhole equipment in the well.

17. The method of claim 16, comprising sending a signal current through the center conductor from the surface to the downhole equipment in a wellbore of the well.

18. The method of claim 16, comprising sending a second signal current from the downhole equipment to the surface through the extra conductive layer.

19. The method of claim 16, comprising sending power from the surface to the downhole equipment through the cable assembly.

20. The method of claim 16, wherein the cable assembly further comprises a plurality of the air gaps.

* * * * *